US010077689B2

(12) United States Patent
Hoglund et al.

(10) Patent No.: US 10,077,689 B2
(45) Date of Patent: Sep. 18, 2018

(54) COMBUSTION ENGINE AND GAS HANDLING SYSTEM FOR PNEUMATIC OPERATION OF A VALVE ACTUATOR

(71) Applicant: FREEVALVE AB, Angelholm (SE)

(72) Inventors: Anders Hoglund, Munka Ljungby (SE); Urban Carlson, Helsingborg (SE); Christian Von Koenigsegg, Vejbystrand (SE)

(73) Assignee: Freevalve AB, Angelholm (SE)

( * ) Notice: Subject to any disclaimer, the term of this patent is extended or adjusted under 35 U.S.C. 154(b) by 145 days.

(21) Appl. No.: 15/025,436

(22) PCT Filed: Oct. 8, 2014

(86) PCT No.: PCT/SE2014/051185

§ 371 (c)(1),
(2) Date: Mar. 28, 2016

(87) PCT Pub. No.: WO2015/057131

PCT Pub. Date: Apr. 23, 2015

(65) Prior Publication Data

US 2016/0237866 A1 Aug. 18, 2016

(30) Foreign Application Priority Data

Oct. 16, 2013 (SE) ..... 1351231

(51) Int. Cl.
*F01L 9/02* (2006.01)
*F15B 11/06* (2006.01)
*F15B 1/26* (2006.01)

(52) U.S. Cl.
CPC ..... *F01L 9/026* (2013.01); *F15B 11/06* (2013.01); *F15B 1/26* (2013.01)

(58) Field of Classification Search
CPC ..... F01L 9/026; F15B 1/26; F15B 11/06
(Continued)

(56) References Cited

U.S. PATENT DOCUMENTS 6,223,846 B1 5/2001 Schechter
8,424,499 B2 * 4/2013 Rioli ..... F01L 1/465 123/90.12
2013/0098337 A1 4/2013 Carlson et al.

FOREIGN PATENT DOCUMENTS

CN 1200435 12/1998
CN 1745228 3/2006
(Continued)

OTHER PUBLICATIONS

Rioli et al., Pneumatic System for Controlling the Valves of an Internal Combustion Engine, US Patent Application Pub. No. US2011/0030630 A1, Feb. 10, 2011.*
(Continued)

*Primary Examiner* — Ching Chang
(74) *Attorney, Agent, or Firm* — Young & Thompson

(57) ABSTRACT

A combustion engine includes, a first controllable engine valve (8) arranged to selectively open/close a combustion chamber (7) included in the combustion engine (1), and a gas handling system arranged to drive the first engine valve (8), which gas handling system includes a closed pneumatic pressure fluid circuit, wherein the closed pressure fluid circuit includes, coupled in series with each other, a compressor (31) and a valve actuator (10) that are operatively connected to the first engine valve (8). The combustion engine is characterized by the gas handling system further including a gas accumulator (38) that is connected with the closed pressure fluid circuit via at least one gas accumulator conduit (39), which includes a controllable valve (40). A gas handling system for pneumatic control of a valve actuator is also described.

14 Claims, 6 Drawing Sheets

(58) Field of Classification Search
USPC ..... 123/90.12, 90.13, 14
See application file for complete search history.

(56) References Cited

FOREIGN PATENT DOCUMENTS

| | | | |
|---|---|---|---|
| DE | 1 159 690 | B | 12/1963 |
| DE | 4 411 934 | C1 | 3/1995 |
| DE | 10 2009 056 797 | A1 | 6/2011 |
| EP | 0 328 195 | A2 | 8/1989 |
| GB | 190800449 | A | 1/1909 |
| WO | 2004070239 | | 8/2004 |

OTHER PUBLICATIONS

European Supplementary Search Report issued in Application No. 14853827.5, dated May 3, 2017.
China Office Action dated Mar. 1, 2017, with English Translation; Application No. 201480056731.6.
International Search Report, dated Feb. 17, 2015, from corresponding PCT application.

* cited by examiner

COMBUSTION ENGINE AND GAS HANDLING SYSTEM FOR PNEUMATIC OPERATION OF A VALVE ACTUATOR

TECHNICAL FIELD OF THE INVENTION

The present invention relates in general to a combustion engine suitable for powering a vehicle, such as a car or a truck, a boat etc. or a machine such as an electric power generation unit or the like. The combustion engines concerned are camshaft free piston engines, which are also known under the concept "engines with free valves". The present invention relates in particular to a combustion engine comprising a first controllable engine valve arranged to selectively open/close a combustion chamber included in the combustion engine, and a gas handling system arranged to drive said first engine valve, which gas handling system comprises a closed pneumatic pressure fluid circuit, wherein the closed pressure fluid circuit comprises, coupled in series with each other, a compressor and a valve actuator that is operatively connected to said first engine valve.

In a second aspect, the present invention relates to a gas handling system for pneumatic operation of a valve actuator.

BACKGROUND OF THE INVENTION AND STATE OF THE ART

In a camshaft free combustion engine a pressure fluid, such as a liquid or a gas, is used to achieve a displacement/opening of one or more engine valves. This means that the camshafts, and related equipment, that conventional combustion engines use to open engine valves to let air in respective let exhaust fumes out from the combustion chamber, has been replaced by a less volume demanding and more controllable system.

In an engine that is constructed for significant angular momentum outputs, the pressure in the combustion chamber is increasing proportional to an increased angular momentum output, and the force that is required to open the valve actuator to open the, in relation to the combustion chamber inward opening, engine valve consequently also increases proportional to an increased angular momentum output. At high numbers of revolutions, such as 6-8000 rpm, a very fast opening of the engine valve is also required for the filling of air respective evacuation of exhaust fumes from the engine cylinder not to be restricted. These requirements, i.e. the need for an extremely fast opening at high frequencies in a high performance engine having high counter pressure in the combustion chamber of the engine at the opening of the exhaust valves, require the pressure of the pressure fluid upstream of the valve actuator to be high, in the order of 8-30 bar. Downstream the valve actuator, the pressure fluid has a lower pressure, in the order of 3-6 bar.

At high numbers of revolution and high engine loads, the pressure difference between the low pressure side and the high pressure side should be in the order of 15-20 bar to achieve a correct operation of the valve actuators, and when the engine is idle running, or at low numbers of revolution and low loads, the pressure difference between the low pressure side and the high pressure side only needs to be in the order of 2-5 bar. The lower pressure difference at low numbers of revolution is desirable when the pressure is increased by way of a compressor from the low pressure side to the high pressure side, and at the pressure increase, energy consumption occurs that increases concurrently with increased pressure on the high pressure side.

In situations that require fast acceleration and/or very fast change from low numbers of revolution and low load to high numbers of revolutions and high load, for example when entering on a busy main road or at a sudden overtaking of a slow moving vehicle, the pressure difference between the low pressure side and the high pressure side must immediately be increased to achieve the acceleration that the driver requires. A conventional compressor is dimensioned to be able to generate pressure differences with greatly varying magnitude, they are however not dimensioned to satisfy the requirement of immediate shifts between separate great pressure difference levels and pressure fluid flows.

Furthermore, there is inertness in the present systems to go from a great pressure difference to a small pressure difference, i.e. when the vehicle again is operated at low numbers of revolution after the short/temporary rise in numbers of revolutions/engine load, it will take time before the pressure difference and thereby the high energy consumption has decreased to a desired level.

BRIEF DESCRIPTION OF THE PURPOSE OF THE INVENTION

The aim of the present invention is to set aside the abovementioned drawbacks and shortcomings of the previously known combustion engines and to provide an improved combustion engine. A fundamental object of the invention is to provide an improved combustion engine of the initially defined type, which is arranged to be able to immediately increase the pressure difference between the low pressure side and the high pressure side by increasing the pressure on the high pressure side of the pressure fluid circuit at the need of a rapid increase in the numbers of revolution/engine load of the combustion engine.

A further object with the present invention is to provide a combustion engine that can rapidly go from a great pressure difference to a small pressure difference between the low pressure side and the high pressure side.

It is another object with the present invention to provide a combustion engine that, after each sudden increase in pressure difference, is self priming before the subsequent need for a sudden increase of pressure difference.

BRIEF DESCRIPTION OF THE FEATURES OF THE INVENTION

According to the invention, the main object is at least achieved by way of the initially defined combustion engine and of a gas handling system for pneumatic operation of a valve actuator having the features defined in the independent claim. Preferred embodiments of the present invention are further defined in the subsequent dependent claims.

According to a first aspect of the present invention, a combustion engine of the initially defined type is provided that is characterized in that the gas handling system further comprises a gas accumulator that is connected to the closed pressure fluid circuit via at least one gas accumulator conduit, which includes a controllable valve.

According to a second aspect of the present invention, a gas handling system for pneumatic operation of a valve actuator is provided comprising a closed pneumatic pressure fluid circuit, wherein the closed pressure fluid circuit comprises, coupled in series with each other, a compressor and a valve actuator. The gas handling system is characterized by comprising a gas accumulator that is connected to the closed pressure fluid circuit via at least one gas accumulator conduit, which comprises a controllable valve.

The present invention is thus based on the insight that a gas accumulator is arranged to store earlier pressure peaks to rapidly be able to supply a large volume of pressure fluid under high pressure to the closed pressure fluid circuit, for the purpose of achieving an immediate pressure increase on the high pressure side of the pressure fluid circuit.

According to a preferred embodiment of the present invention, the closed pressure fluid circuit comprises a primary pressure fluid channel that extends from the compressor to an inlet opening of the valve actuator, wherein the gas accumulator is connected to the primary pressure fluid channel via a first gas accumulator conduit, which comprises a controllable valve.

According to a preferred embodiment of the present invention, the gas accumulator is connected to said primary pressure fluid channel via a second gas accumulator conduit, which comprises a non-return valve arranged to allow a flow in a direction toward the gas accumulator. This way, it is guaranteed that when the controllable valve in the first gas accumulator conduit is closed, the pressure in the gas accumulator is always equally high as the highest pressure peak in the high pressure side of the closed fluid circuit.

According to a preferred embodiment, the compressor has a variable displacement. This means that the pressure increase of the high pressure side of the pressure fluid circuit can be sped up further by increasing the displacement of the compressor in connection with a rapidly increased number of revolutions or load. The size of the displacement is preferably controlled by the pressure difference between the upper side and lower side of the compressor pistons, i.e. the pressure ratio over the compressor.

According to a preferred embodiment, the closed pressure fluid circuit comprises a secondary pressure fluid channel that extends from the cylinder head chamber to the compressor, wherein the gas accumulator is connected with said secondary pressure fluid channel via a third gas accumulator conduit, which comprises a controllable valve. Thereto, it is preferred that a non-return valve is arranged in said secondary pressure fluid channel upstream the position where the third gas accumulator conduit discharge in the secondary pressure fluid channel, wherein the non-return valve is arranged to allow a flow in a direction toward the compressor. This leads to the average pressure on the uppers side of the compressor pistons increases, which leads to a rapid increase in the displacement of the compressor.

Further advantages with and features of the invention are evident from the remaining dependent claims and from the following detailed description of preferred embodiments.

BRIEF DESCRIPTION OF THE DRAWINGS

A more thorough understanding of the abovementioned and other features and advantages of the present invention will be evident from the following detailed description of preferred embodiments with reference to the enclosed drawings, on which.

DETAILED DESCRIPTION OF PREFERRED EMBODIMENTS

Figure 1:
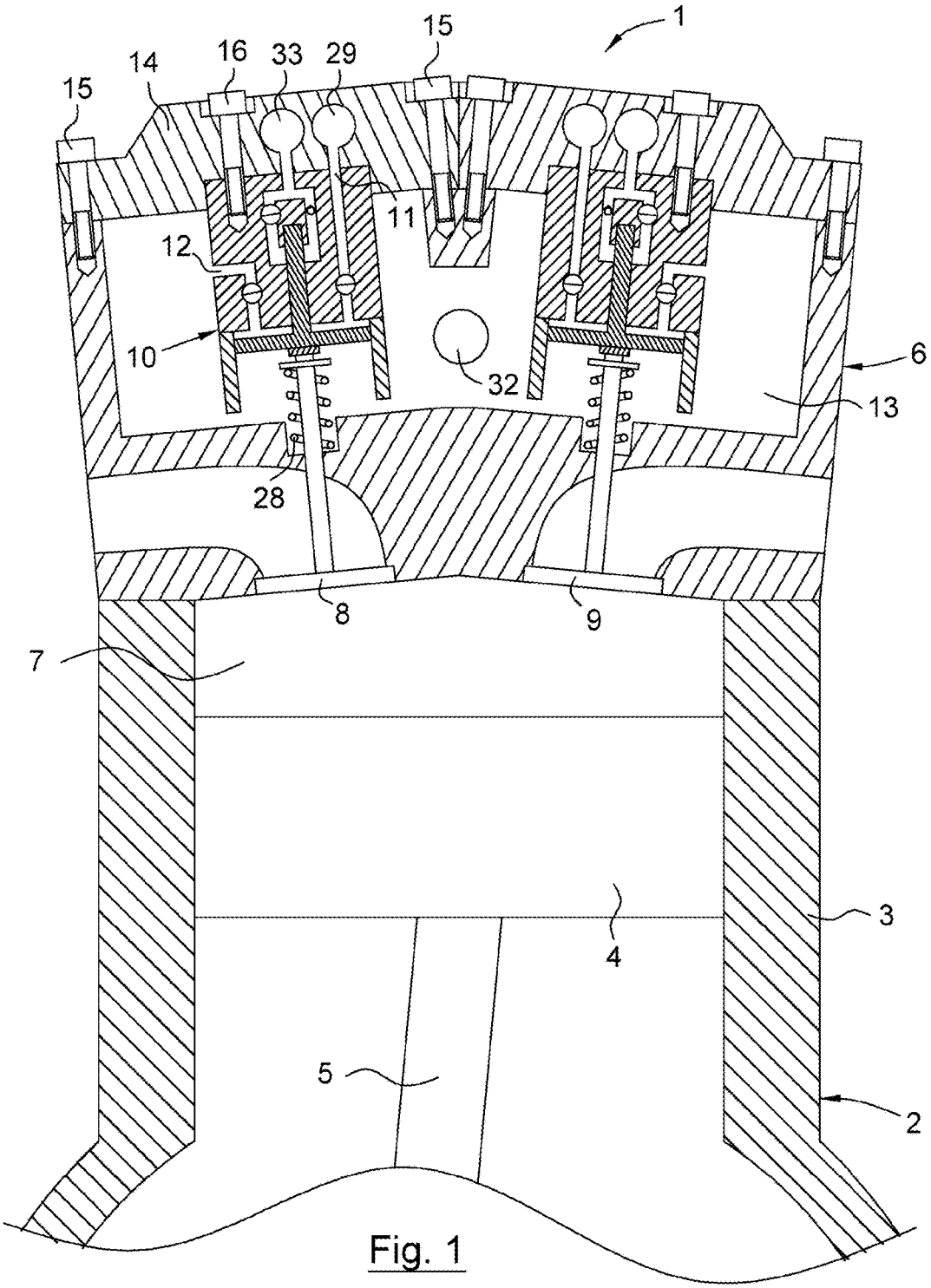
FIG. 1 is a schematic cross-sectional side view of a part of a combustion engine.

Reference is initially made to FIG. 1 that is a schematic depiction of a part of an inventive combustion engine, generally denoted 1. The combustion engine 1 comprises a cylinder block 2 with at least one cylinder 3. Said cylinder block 2 generally comprises three or four cylinders 3. In the shown embodiment reference is made only to one cylinder 3, it should nevertheless be realized that he equipment described below in relation to the shown cylinder 3 is preferably applied to all of the cylinders of the combustion engine 1, in the embodiment the combustion engine comprises more cylinders.

Furthermore, the combustion engine 1 comprises a piston 4 that is axially displaceable in said cylinder 3. The movement, axial displacement back and forth, of the piston 4 is transferred on a conventional manner to a connection rod 5 connected to the piston 4, the connection rod 5 in turn is connected to and drives a crank shaft (not shown) in rotation.

The combustion engine 1 also comprises a cylinder head 6 that together with said cylinder 3 and said piston 4 delimits a combustion chamber 7. In the combustion chamber 7 the ignition of a mix of fuel and air occurs in a conventional manner and is not further described herein. The cylinder head 6 comprises at least one controllable first engine valve 8, also known as a gas exchange valve. In the shown embodiment, the cylinder head also comprises a controllable second engine valve 9. The one engine valve 8 constitutes, in the shown embodiment, an inlet valve that is arranged to selectively open/close for supply of air to the combustion chamber 7, and the second engine valve 9 constitutes in the shown embodiment an air outlet valve, or exhaust valve, that is arranged to selectively open/close for evacuation of exhausts form the combustion chamber 7.

The combustion engine 1 further comprises a first valve actuator, generally denoted 10, that is operatively connected to said first engine valve 8 and that is arranged in a closed pressure fluid circuit of the combustion engine 1. The valve actuator 10 comprises a pneumatic pressure fluid circuit with at least one inlet opening 11 for pressure fluid and at least one outlet opening 12 for pressure fluid. The pressure fluid is a gas or a gas mixture, preferably air or nitrogen gas. Air has the advantage that it is easy to change the pressure fluid or to supply more pressure fluid if the closed pressure fluid circuit leak, and nitrogen gas has the advantage that it lacks oxygen, which prevents oxidation of other elements.

In the case the combustion engine comprises several valve actuators are these arranged in parallel to one another in said closed pressure fluid circuit. Each valve actuator can be operatively connected with one or more engine valves, the combustion engine can for example comprise two air inlet valves 8, which are jointly driven by the same valve actuator 10. Nevertheless, it is preferred that each valve actuator operates one engine valve each to achieve the greatest possible controllability of the operation of the combustion engine 1.

The description below of the combustion engine will only include one engine valve 8 and one valve actuator 10, but it should be realized that the corresponding also applies to all engine valves and valve actuators if nothing else is said.

The combustion engine 1 also comprises a cylinder head chamber 13 that forms part in said closed pressure fluid circuit and that is delimited by said cylinder head 6 and at least a first cylinder head mantle 14. In the shown embodiment, the cylinder head mantle 14 is divided in two parts, which are individually attachable to and releasable from the cylinder head 6 by way of bolts. The cylinder head chamber 13 preferably presents a volume in the order of 3-10 liter, typically in the order of 5-6 liter. In an alternative embodiment, only a cylinder head mantle 14 is present that, together with the cylinder head 6, delimits the cylinder head chamber 13.

The at least one outlet opening 12 of the valve actuator 10 is in fluid communication with the cylinder head chamber 13, i.e. that the pressure fluid leaving the valve actuator 10 via said at least one outlet opening 12 flows out in the cylinder head chamber 13. In those case where the combustion engine 1 comprises several valve actuators, all outlet openings of the valve actuators for pressure fluid discharge in the same cylinder head chamber.

Preferably, the whole of the valve actuator 10 is arranged in said cylinder head chamber 13, and it is also preferred that the valve actuator 10 is releasably connected to said cylinder head mantle 14, for example by a bolt 16, or similar holding means. In this embodiment, the valve actuator 10 accordingly "hangs" in the cylinder head mantle 14 without being in contact with the cylinder head 6. If the valve actuator 10 should be in contact with both the cylinder head mantle 14 and the cylinder head 6, a construction wise disadvantageous tolerance chain is achieved.

Figure 2:
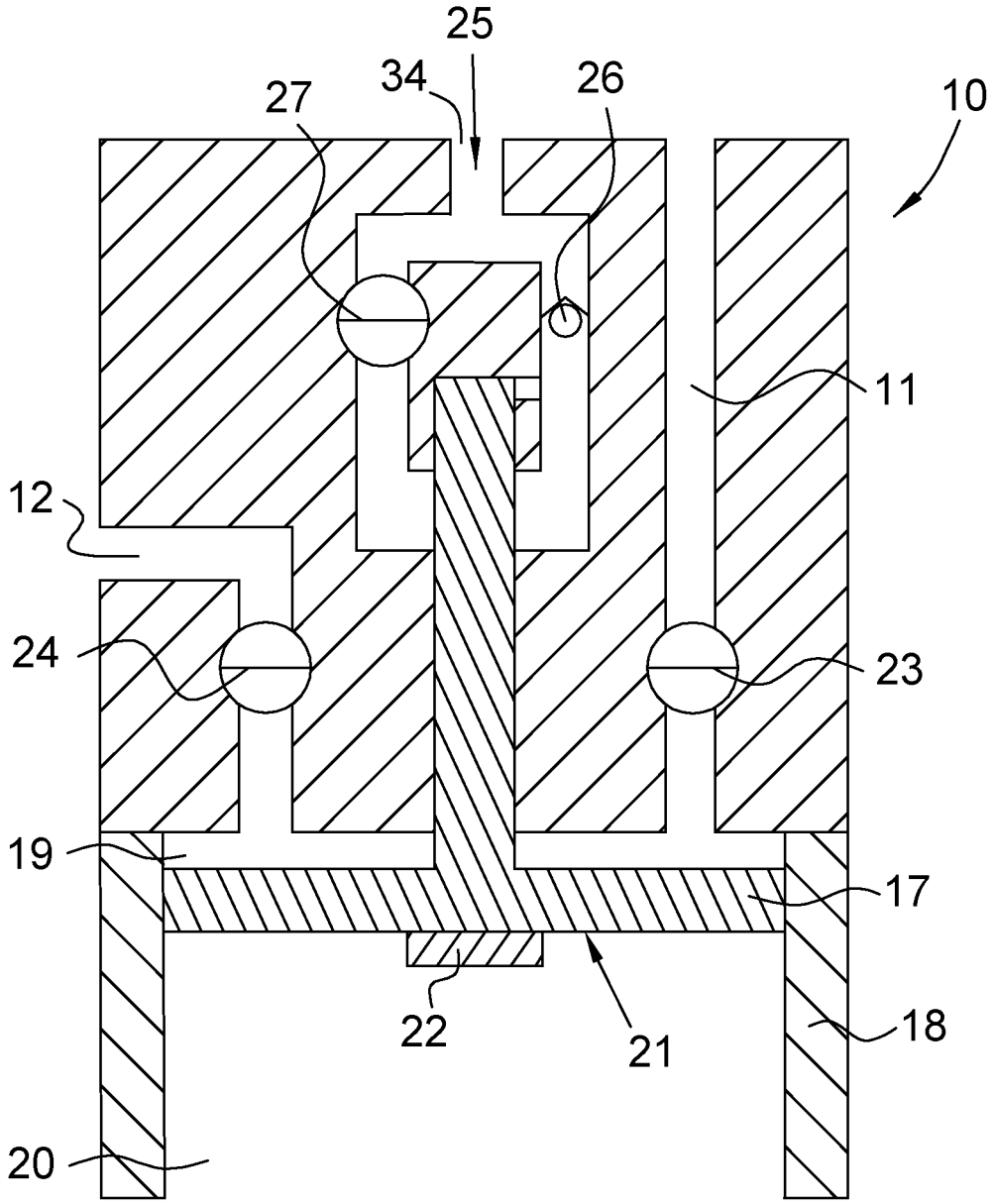
FIG. 2 is a schematic cross-sectional side view of a valve actuator.

Reference is now made to FIG. 2, which shows a schematic depiction of the valve actuator 10.

The valve actuator 10 comprises an actuator piston disc 17 and an actuator cylinder 21 delimiting a downward open cylinder volume. The actuator piston disc 17 divides said cylinder volume in a first upper part 19 and a second lower part 20 and is axially displaceable in said actuator cylinder 21. The actuator piston disc 17 forms part of an actuator piston, generally designated 21, that is arranged to contact and drive said first engine valve 8. The actuator piston further comprises means 22 for play elimination in axial direction in relation to said first engine valve 8.

The play eliminating means 22 are preferably hydraulic, and assures that when the actuator piston disc 21 is in its upper turn position, the actuator piston 21 remains in contact with the first engine valve 8 when it is closed, for the purpose of correcting for assembly tolerances, heat expansion, etc. Accordingly, the axial length of the actuator piston 21 is adjusted by way of the play eliminating means 22.

The other part 20 of the cylinder volume of the valve actuator 10 is in fluid communication with said cylinder head chamber 13. This way, it is guaranteed that the same pressure acts on the actuator piston disc 17 from the first part 19 of the cylinder volume respective from the second part 20 of the cylinder volume when the actuator piston 21 is in the upper turn position. Thereby, the sealing between the actuator piston disc 17 and the actuator cylinder 12 is not critical, but some leakage can be allowed for minimizing the resistance to displacement of the actuator piston disc 17, and in resting position, the actuator piston disc is not affected by changes in the low pressure level.

The valve actuator 10 comprises a controllable inlet valve 23 that is arranged to open/close the inlet opening 12, a controllable outlet valve 27 that is arranged to open/close the outlet opening 11, a hydraulic circuit, generally designated 25, that in turn comprises a non-return valve 26 arranged to allow filling of the hydraulic circuit 25, and a controllable emptying valve 27 arranged to control the emptying of the hydraulic circuit 25. It should be pointed out that the valves in the valve actuator 10 are schematically depicted and can for example be constituted by sliding valves, seat valves, etc. Furthermore, several of the abovementioned controllable valves may be constituted by a single body. Each valve can further be directly or indirectly electrically controlled. With directly electrically controlled is meant that the position of the valve is directly controlled by, for example, an electromagnetic device, and with indirect electrically controlled is meant that the position of the valve is controlled by a pressure fluid that in turn is controlled by, for example, an electro-magnetic device.

To achieve a displacement of the actuator piston disc 17 downward for opening the engine valve 8, the inlet valve 26 is opened to allow a filling of pressure fluid with a high pressure in the upper part 19 of the cylinder volume. When the actuator piston 21 is displaced downward, the non-return valve 26 of the hydraulic circuit 25 opens, whereupon hydraulic liquid is sucked in and replaces the volume that the actuator piston 21 leaves. Thereafter, the inlet valve 23 is closed and the pressure fluid that has entered in the upper part 19 of the cylinder volume is allowed to expand, whereupon the actuator piston disc 17 continues its movement downward. When the pressure fluid in the upper part 19 of the cylinder volume is not able to displace the actuator piston disc 17 further, i.e. when the pressure on the under side of the actuator piston disc 17 and the return spring 28 of the engine valve 8 is as high as the pressure on the upper side of the actuator piston disc 17, the actuator piston disc 17 stops. The actuator piston disc 17 is held (locked) in its lower position a desired amount of time by keeping the emptying valve 27 of the hydraulic circuit 25 closed at the same time as the non-return valve 26 of the hydraulic circuit 25 is automatically closed. To achieve a return movement, the outlet valve 24 is opened to allow an evacuation of pressure fluid from the upper part 19 of the cylinder volume, and additionally the emptying valve 27 of the hydraulic circuit 25 is opened, whereupon the actuator piston disc is displaced upward when the hydraulic liquid is evacuated from the hydraulic circuit 25, and at the same time, the pressure fluid is evacuated from the upper part 17 of the cylinder volume to the cylinder head chamber 13.

Figure 3:
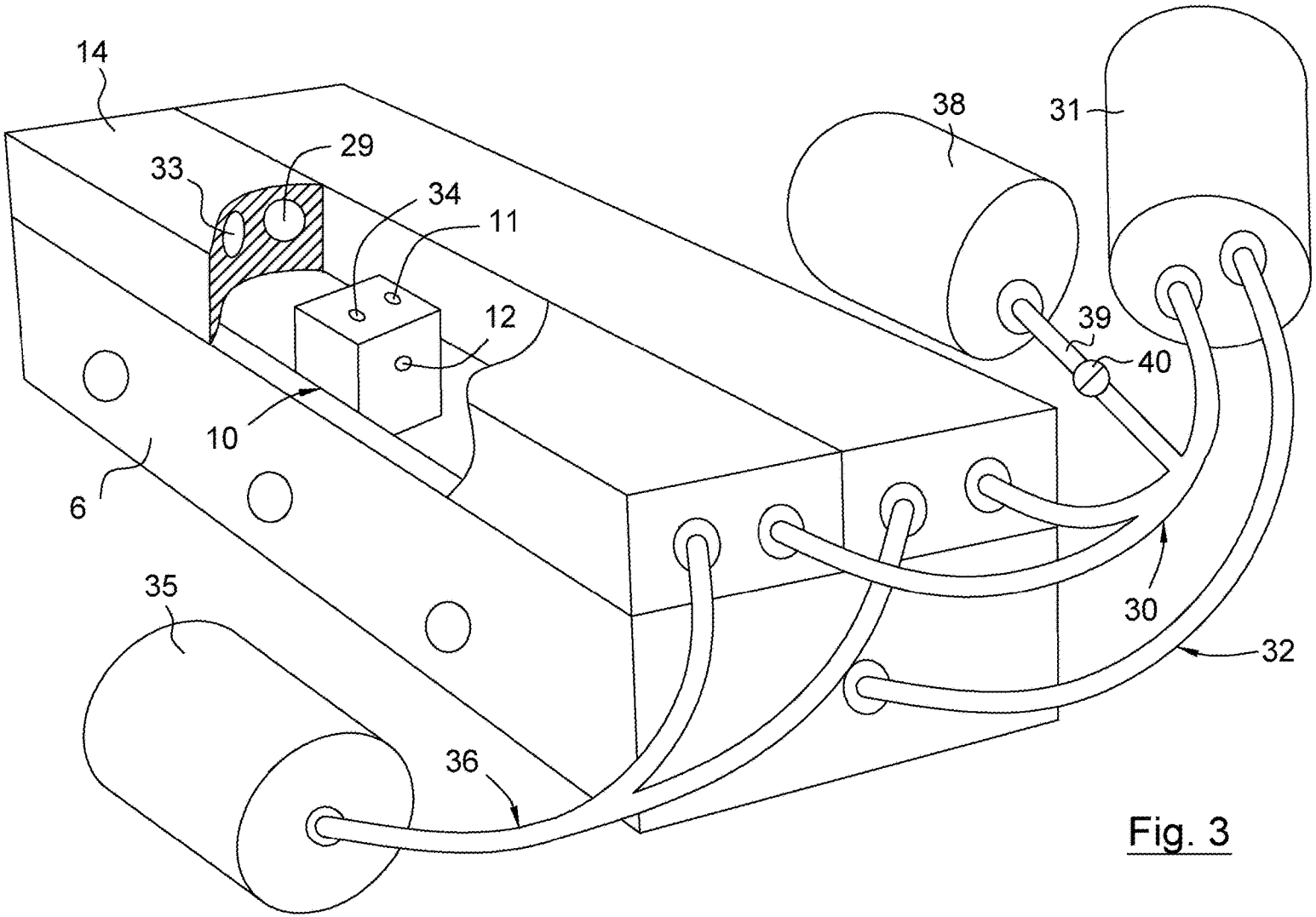
FIG. 3 is a partly cross-sectional schematic perspective view of a cylinder head and cylinder head mantles.

Reference is now made primarily to FIG. 3, which shows a partly cross-sectional schematic perspective view of, among other things, a cylinder head and cylinder head mantles.

The cylinder head mantle 14 comprises a pressure fluid manifold 29 that is connected to the at least one inlet opening 11 of the valve actuator 10. The pressure fluid manifold 29 extends along the axial length of the cylinder head mantle 14. Said pressure fluid manifold 29 forms part of a primary pressure fluid channel 30 that extends from a compressor 31 to the at least one inlet opening 11 of the valve actuator 10. The compressor 31 is arranged to supply a pressure fluid under high pressure to the valve actuators. Furthermore, a secondary pressure fluid channel 32 (see also FIG. 1) extends from the cylinder head chamber 13 to said compressor 31.

The volume of the primary pressure fluid channel 30, high pressure side, shall be kept as small as possible so that the temperature of the pressure fluid will sink as little as possible from the compressor 31 to the valve actuator 10. The volume of the cylinder head chamber 13 and the secondary pressure fluid channel 32, low pressure side, shall on the other hand be maximized so that the pressure ratio between the low pressure side and the high pressure side is affected as little as possible when the compressor 31 pulls gas/pressure fluid from the low pressure side. Preferably, the volume of the cylinder head chamber 13 and the secondary pressure fluid channel 32 is at least ten times greater than the volume of the primary pressure fluid channel 30, most preferably at least 15 times greater.

The compressor 31 has variable compressor volume/displacement, or by other means adjustable outflow, and generally the compressor 31 is driven by the crank shaft of the combustion engine 1. At high numbers of revolutions and high torque output, higher pressure of the pressure fluid in the primary pressure fluid channel 30 is required, and at low numbers of revolutions and low torque output, lower pressure of the pressure fluid in the primary pressure fluid channel 30 is required. The pressure difference between the high pressure side and the low pressure side is in the order of 15-20 bar at high numbers of revolution/torque loads and in the order of 2-5 bar at low numbers of revolution and low engine loads. The compressor 31 is preferably of the type axial piston pump or swashplate pump, which provides a variable displacement by way of several pistons with variable stroke, where all pistons are arranged in mutually different positions in their respective cycles. The stroke is determined by the inclination of a glide plate, which acts against, and by rotation drives the pistons to perform an axial movement, and central axis of the glide plate performs a nutating motion. For each revolution the glide plate is turned, all pistons will perform one cycle. The inclination of the glide plate is thus variable/adjustable.

The pressure level on the high pressure side in in the order of 8-30 bar to, with sufficient speed, open an inward opening engine valve where a high counter pressure is present in the combustion chamber, and the pressure level on the low pressure side is in the order of 4-8 bar.

The cylinder head mantle 14 further comprises a hydraulic liquid manifold 33 that is connected with an inlet opening 34 of said hydraulic circuit 25 of the valve actuator 10. The hydraulic liquid manifold 33 extends along the axial length of the cylinder head mantle 14, parallel to the pressure fluid manifold 29. A pump 35, or the like, is arranged to supply a pressurized hydraulic liquid to the hydraulic liquid manifold 33 via a conduit 36. The cylinder head mantle 14 further comprises all necessary electric infrastructure (not shown) for, among other things, controlling the first valve actuator 10, for various sensors, etc.

Reference is now primarily made to the FIGS. 4-9, which schematically show alternative embodiments of a gas handling system according to the invention for pneumatic control of a valve actuator 10, which gas handling system comprises a pneumatic closed pressure fluid circuit.

In the FIGS. 4-9, a compressor is shown to the right, the primary pressure fluid channel 30 (high pressure side) at the upper edge, the valve actuator 10 to the left, and the secondary pressure fluid channel 32 (low pressure side) at the lower edge. The pressure fluid thus flows counter-clockwise in the figures, which is illustrated by way of an arrow 37 in FIG. 4.

Essential to the present invention is that the gas handling system comprises a gas accumulator 38 that is connected to the closed pressure fluid circuit via at least one gas accumulator conduit, which includes a controllable valve.

Figure 4:
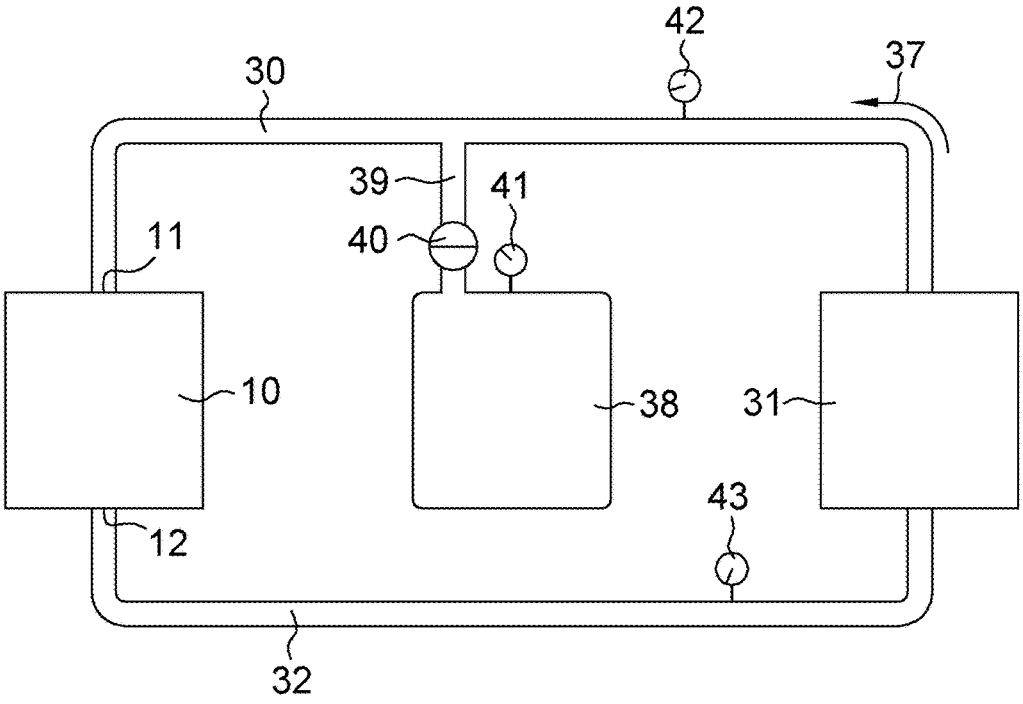
FIG. 4-9 is schematic circuit diagrams showing examples of alternative embodiments of a gas handling system for pneumatic control of a valve actuator.

Reference is now made to FIG. 4, which shows a preferred first embodiment. In this embodiment, the gas accumulator 38 is connected with said primary pressure fluid channel 30 via a first gas accumulator conduit 39, which comprises a controllable valve 40.

At the need of a rapid pressure increase on the high pressure side from a low pressure level to a high pressure level, for example as a response to the accelerator paddle in the vehicle being rapidly pushed down and/or that the number of revolutions rapidly increases, the controllable valve 40 in the first gas accumulator conduit 39 is opened, whereupon the closed in volume, that has a higher pressure level than the pressure level present on the high pressure side, flows into the primary pressure fluid channel 30 and provides an immediate pressure rise on the high pressure side. The pressure level in the gas accumulator is lowered somewhat. The volume of the gas accumulator 38 is preferably at least five times greater than the volume in the primary pressure fluid channel 30. Preferably, the compressor 31 has a variable displacement 31 that is controlled by the pressure relation over the compressor and the pressure on the lower side of the compressor pistons, whereupon the compressor 31 is arranged to, at a pressure increase on the high pressure side, achieve an automatic increase of the displacement of the compressor 31, which lead to a further pressure increase.

Preferably, a first pressure sensor 41 is connected with the gas accumulator 38, and a second pressure sensor 42 is connected with the primary pressure fluid channel 30, to ensure that the pressure level in the gas accumulator 38 is higher than the pressure level in the primary pressure fluid channel 30 before the controllable valve 40 in the first gas accumulator conduit 39 is opened. In the shown embodiment, a third pressure sensor 43 is also connected with the secondary pressure fluid channel 32 to be able to determine the pressure relation between the low pressure side and the high pressure side.

When the pressure in the gas accumulator 38 is used to briefly rise the pressure level in the primary pressure fluid channel 30, the controllable valve 40 in the first gas accumulator conduit 39 is closed. When the pressure level on the high pressure side again shall be lowered, the controllable valve 40 is opened in the first gas accumulator conduit 39 for refilling the gas accumulator 38. The compressor 31 is preferably active to refill the gas accumulator to a predetermined level, irrespective of the need of pressure fluid with high pressure to the valve actuator 10 is remaining or not.

Figure 5:
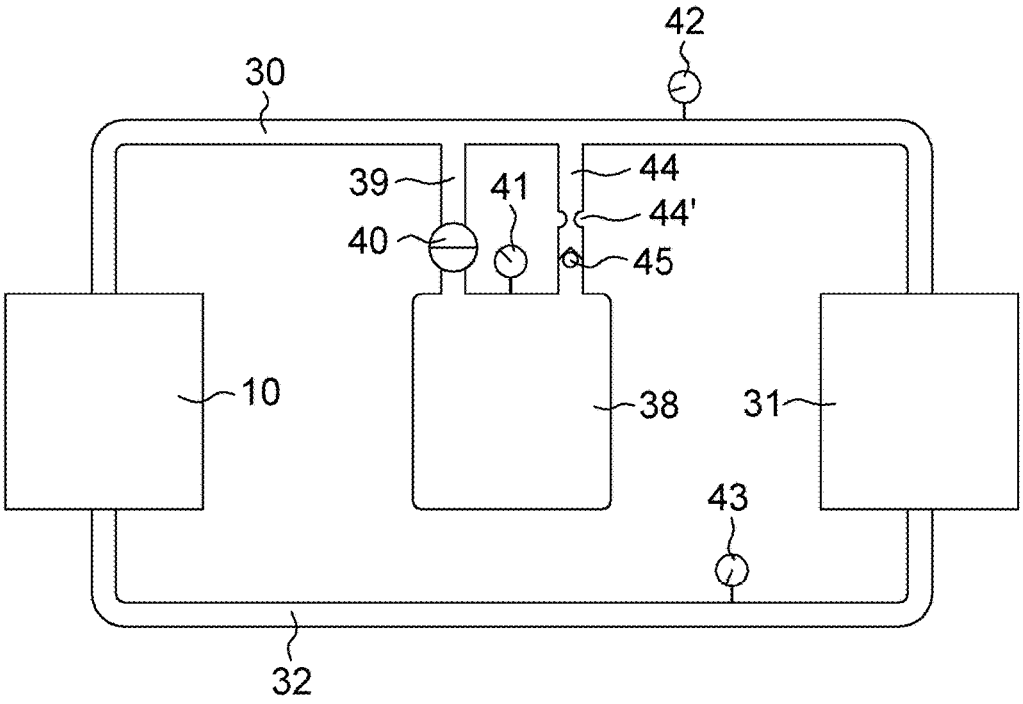

Reference is now made to FIG. 5, which shows a second embodiment. Only differences in relation to the embodiment according to FIG. 4 will be described.

In addition to the first embodiment according to FIG. 4, the combustion engine 1 comprises a second gas accumulator conduit 44 that extends between the primary pressure fluid channel 30 and the gas accumulator 38, and that comprises a non-return valve 44, which is arranged to allow a flow in a direction toward the gas accumulator 38. This way, it is guaranteed that hat the controllable valve 40 in the first gas accumulator conduit 39 can be closed as soon as a desired pressure increase has been achieved in the primary pressure fluid channel 30. Thereafter, the non-return valve 45 in the second gas accumulator conduit 44 guarantees that the latest achieved highest pressure peak in the primary pressure fluid channel 30 is forwarded to and saved in the gas accumulator 38. Accordingly, a simpler and automatic priming of the gas accumulator 38 is achieved. Further, the second gas accumulator conduit 44 also comprises flow restriction means 44', which for example are implemented by way of a constriction. The purpose of the flow restriction means 44' is to delay/limit so that the increased pressure that the compressor 31 delivers is not at first hand used to refill the gas accumulator 38.

Figure 6:
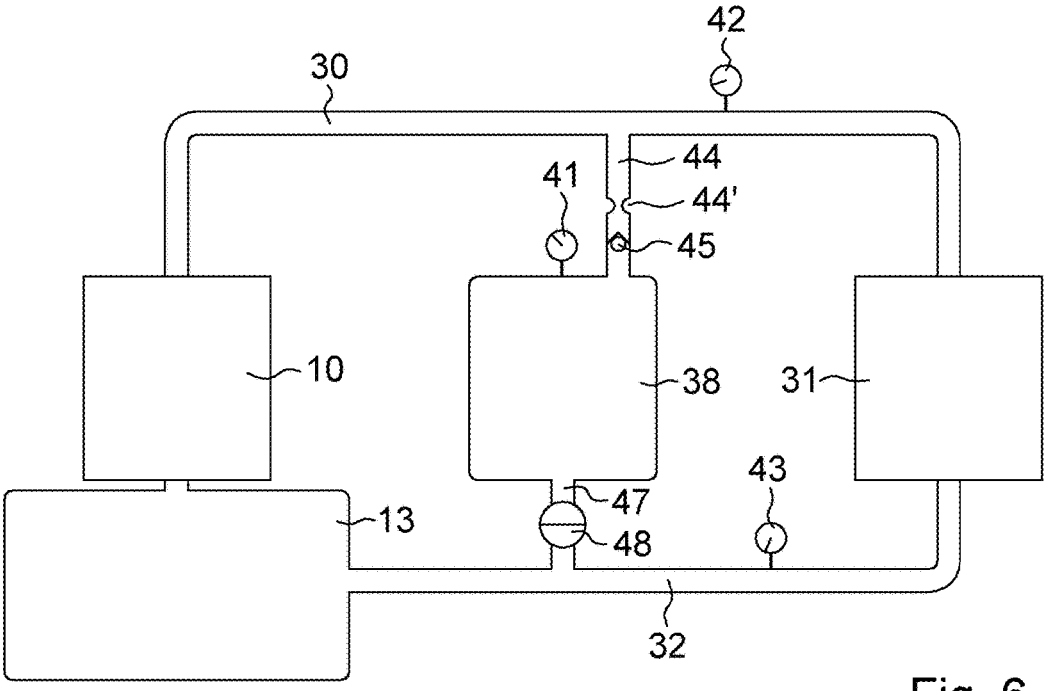

Reference is now made to FIG. 6, which shows a third embodiment. Only differences with respect to the embodiments according to FIGS. 4 and 5 will be described.

In this embodiment, and in the subsequent embodiments, a cylinder head mantle 13 is also shown that is arranged between the secondary pressure fluid channel 32 and the valve actuator 10. It should nevertheless be remarked that the cylinder head chamber 13 can be dispensed with in the third and the subsequent embodiments, and can be included in the first and the second embodiment.

In the third embodiment according to FIG. 6, the gas handling system comprises a gas accumulator conduit 47 that extends between the gas accumulator 38 and the secondary pressure fluid channel 32 and that comprises a controllable valve 48. The first gas accumulator conduit 39 that is shown in the first and second embodiments is not present in the third embodiment.

At the need for a rapid pressure increase on the high pressure side from a low pressure level to a high pressure level, the controllable valve 48 in the third gas accumulator conduit 47 is opened, whereupon the closed in volume of pressure fluid flows into the secondary pressure fluid channel 32. Thereby, the compressor 31 will be fed with a more dense pressure fluid, which gives a more rapid increase of the displacement of the compressor 31 and thereby provides a more rapid pressure increase on the high pressure side. Preferably, the third gas accumulator conduit 47 is connected with the secondary pressure fluid channel 32 close to or in direct connection with the compressor, in other words, the third gas accumulator conduit 47 is most preferably connected with the secondary pressure fluid channel 32 in the interface between the compressor 31 and the secondary pressure fluid channel 32.

Preferably, the compressor 31 has a variable displacement that is controlled by the pressure relation over the compressor 31 and the pressure on the under side of the compressor pistons, whereupon the compressor 31 is arranged to, at a pressure rise at the inlet of the compressor 31, automatically increase the displacement of the compressor.

Figure 7:
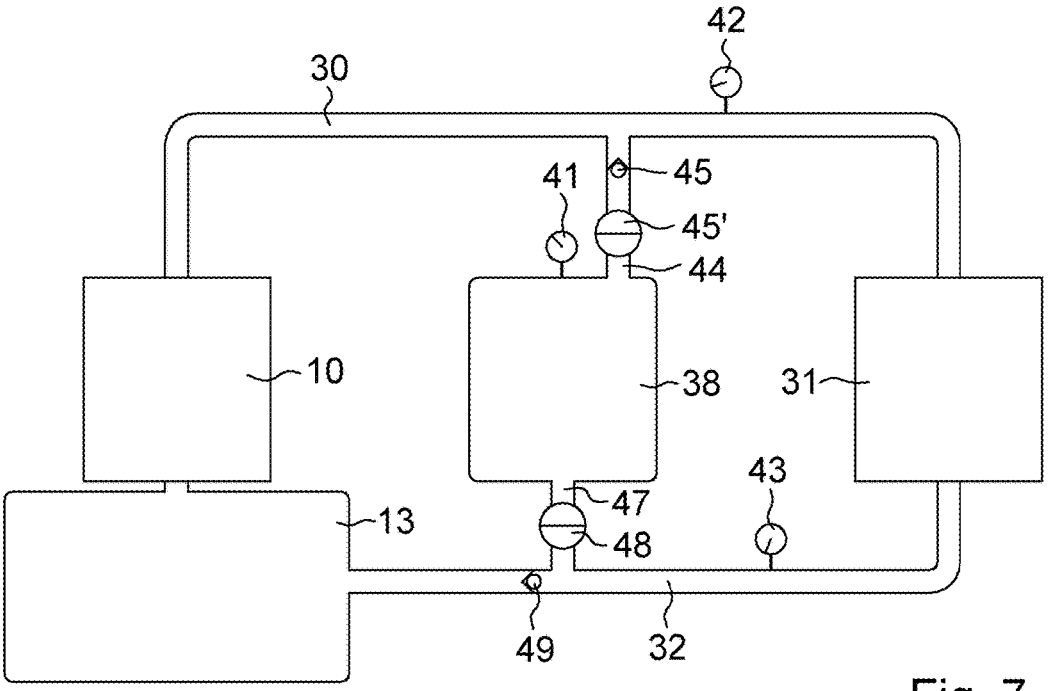

Reference is now made to FIG. 7, which disclose a fourth embodiment. Only differences in relation to the embodiment according to FIG. 6 will be described.

In the fourth embodiment according to claim 7, the second gas accumulator conduit 44 comprises, in addition to the non-return valve 45, a controllable valve 45' to prevent a refilling of the gas accumulator 38 when the need for a pressure rise on the high pressure side remains.

It is further preferred that a non-return valve 49 is arranged in the secondary pressure fluid channel 32 upstream the position where the third gas accumulator conduit 47 discharge in the secondary pressure fluid channel 32, which non-return valve 49 is arranged to allow a flow in the direction toward the compressor, and thus preventing that the supplied pressure fluid flows into the cylinder head chamber 13.

In an alternative (not shown) embodiment, the third gas accumulator conduit 47 is connected directly to the compressor 31 and the non-return valve 49 is also preferably arranged in the compressor 31.

The controllable valve 45' in the second gas accumulator conduit 44 further leads to the gas accumulator 38 not being refilled/primed before said controllable valve 45" is opened. This leads to the volume in which the pressure should rise is kept at a minimum, whereupon a quicker pressure rise is achieved. When the need for a high pressure in the primary pressure fluid channel 30 decline/cease, the controllable valve 45'in the second gas accumulator conduit 44 is opened, whereupon pressure fluid flows into the gas accumulator 38. Additionally, the displacement of the compressor 31 will automatically decrease, which gives an even faster pressure drop on the high pressure side.

Figure 8:
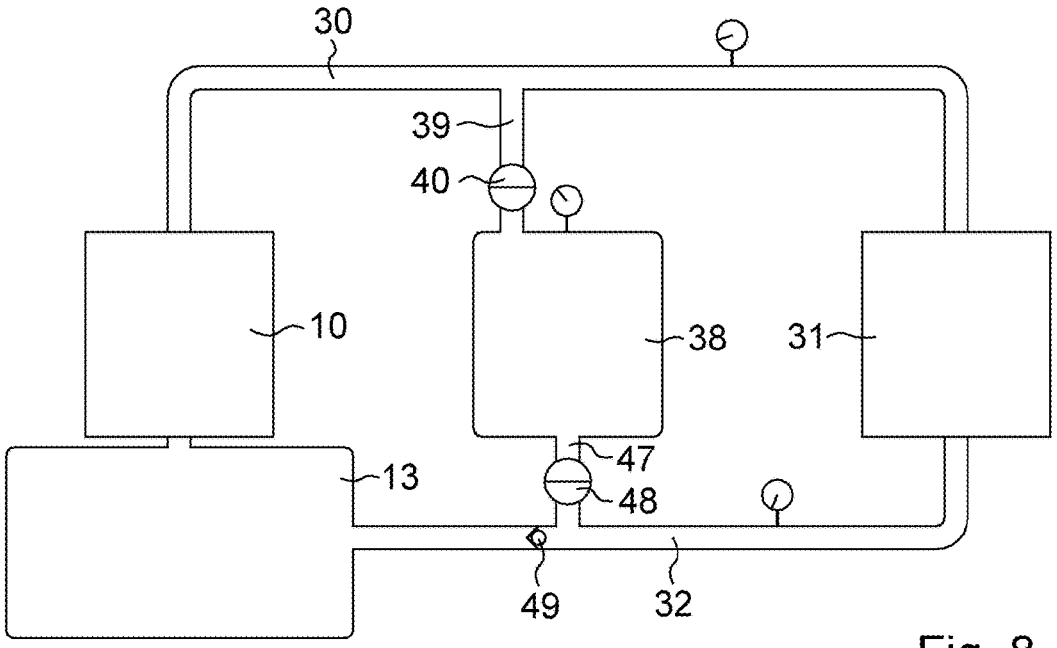

Reference is now made to FIG. 8, which shows a fifth embodiment. Only differences in relation to earlier described embodiments will be described.

The fifth embodiment is a combination of the first embodiment according to FIG. 4 and the fourth embodiment according to FIG. 7. However, this embodiment comprises no second gas accumulator conduit. The fifth embodiment provides a possibility to open and release pressure fluid from the gas accumulator 38, either in the primary pressure fluid channel 30, via the first gas accumulator conduit 39, or in the secondary pressure fluid channel 32, via the third gas accumulator conduit 47.

Figure 9:
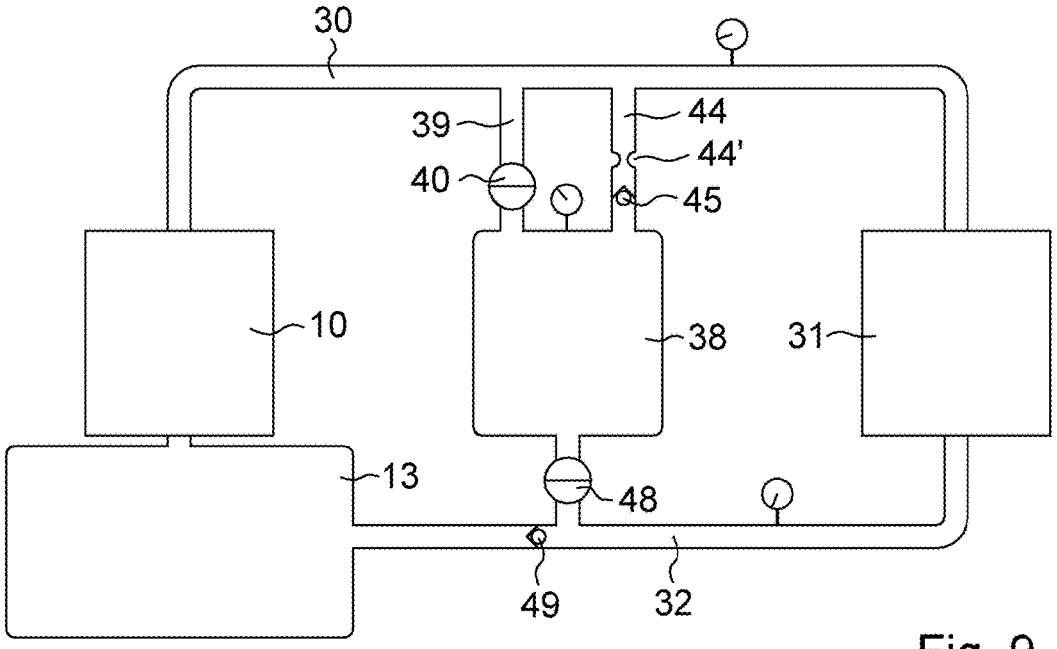

Reference is now made to FIG. 9, which shows a sixth embodiment. Only differences with respect to the earlier embodiments will be described.

The sixth embodiment is a combination of the second embodiment according to FIG. 5 and the fourth embodiment according to FIG. 7. However, this embodiment comprises no controllable valve in the second gas accumulator conduit 44.

Similar to the fifth embodiment according to FIG. 8, the sixth embodiment provides a possibility to open and release the pressure fluid from the gas accumulator, either in the primary pressure fluid channel 30, via the first gas accumulator conduit 39, or in the secondary pressure fluid channel 32, via the third gas accumulator conduit 47. Additionally, the sixth embodiment provides the automatic refilling function of the second embodiment according to FIG. 5.

Conceivable Modifications of the Invention

The invention is not limited to only the abovementioned and embodiments shown in the drawings, which only have an illustrating and exemplifying purpose. This patent application is intended to cover all modifications and variants of the preferred embodiments described herein, and the present invention is consequently defined by the wording of the enclosed claims and the equipment can thus be modified in all conceivable ways within the framework of the enclosed claims.

It should also be pointed out that all information about/concerning terms such as above, below, upper, lower, etc. shall be interpreted/read with the equipment oriented in accordance with the figures, with the drawings oriented in such a way that the reference numbers can be read in a correct manner. Consequently, such terms indicates only relative relationships in the shown embodiments, which relationships can be changed if the equipment according to the invention is provided with another construction/design.

It should be pointed out that even if it is not explicitly stated that features from a specific embodiment can be combined with the features of another embodiment, this should be regarded as obvious when so is possible.

The invention claimed is:

1. A combustion engine comprising:

a first controllable engine valve configured to selectively open/close a combustion chamber included in the combustion engine; and a gas handling system configured to drive said first controllable engine valve, the gas handling system comprising a closed pneumatic pressure fluid circuit comprising, coupled in series with each other, a compressor and a valve actuator that is operatively connected to said first controllable engine valve, and a gas accumulator that is connected to the compressor of the closed pneumatic pressure fluid circuit via at least a compressor-connecting gas accumulator conduit, which includes a controllable valve.

2. The combustion engine according to claim 1, wherein the closed pneumatic pressure fluid circuit comprises a primary pressure fluid channel that extends from the compressor to an inlet opening of the valve actuator.

3. The combustion engine according to claim 2, wherein the gas accumulator is connected with the primary pressure fluid channel via a first gas accumulator conduit, which comprises a controllable valve.

4. The combustion engine according to claim 3, wherein the gas accumulator is connected with said primary pressure fluid channel via a second gas accumulator conduit, which comprises a non-return valve configured to allow a flow in a direction toward the gas accumulator.

5. The combustion engine according to claim 2, wherein the gas accumulator is connected with said primary pressure fluid channel via a second gas accumulator conduit, which comprises a non-return valve configured to allow a flow in a direction toward the gas accumulator.

6. The combustion engine according to claim 5, wherein the second gas accumulator conduit comprises a flow restrictor.

7. The combustion engine according to claim 1, wherein the closed pneumatic pressure fluid circuit comprises a cylinder head chamber coupled in series with the compressor and the valve actuator, and wherein an outlet opening of the valve actuator is in fluid communication with said cylinder head chamber.

8. The combustion engine according to claim 7, wherein the closed pneumatic pressure fluid circuit comprises a secondary pressure fluid channel that extends from the cylinder head chamber to the compressor, and wherein the gas accumulator is connected with said secondary pressure fluid channel via the compressor-connecting gas accumulator conduit.

9. The combustion engine according to claim 8, wherein a non-return valve is disposed in said secondary pressure fluid channel upstream from the position where the compressor-connecting gas accumulator conduit discharges in the secondary pressure fluid channel, and wherein the non-return valve is configured to allow a flow in a direction toward the compressor.

10. The combustion engine according to claim 9, wherein the compressor-connecting gas accumulator conduit is connected with the secondary pressure fluid channel in the interface between the compressor and said secondary pressure fluid channel.

11. The combustion engine according to claim 8, wherein the compressor-connecting gas accumulator conduit is connected with the secondary pressure fluid channel in the interface between the compressor and said secondary pressure fluid channel.

12. The combustion engine according to claim 1, wherein the closed pneumatic pressure fluid circuit comprises a secondary pressure fluid channel that extends from the cylinder head chamber to the compressor, wherein a non-return valve is disposed in the compressor upstream the position where the compressor-connecting gas accumulator conduit discharges in the compressor, and wherein the non-return valve is configured to allow a flow in a direction from the secondary pressure fluid channel.

13. The combustion engine according to claim 1, wherein the compressor has a variable displacement.

14. A gas handling system for pneumatic operation of a valve actuator, the gas handling system comprising:

a closed pneumatic pressure fluid circuit comprising, coupled in series with each other, a compressor and a valve actuator; and a gas accumulator that is connected to the compressor of the closed pneumatic pressure fluid circuit via at least a compressor-connecting gas accumulator conduit, which comprises a controllable valve.

* * * * *